US010603895B2

(12) United States Patent
Havive

(10) Patent No.: US 10,603,895 B2
(45) Date of Patent: Mar. 31, 2020

(54) PRINTED OUTPUT INSPECTION

(71) Applicant: HP INDIGO B.V., Amstelveen (NL)

(72) Inventor: Moshe Havive, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 280 days.

(21) Appl. No.: 15/545,970

(22) PCT Filed: Apr. 30, 2015

(86) PCT No.: PCT/EP2015/000881

§ 371 (c)(1),
(2) Date: Jul. 24, 2017

(87) PCT Pub. No.: WO2016/173606

PCT Pub. Date: Nov. 3, 2016

(65) Prior Publication Data

US 2018/0015716 A1 Jan. 18, 2018

(51) Int. Cl.

| | |
|---|---|
| ***B41J 15/16*** | (2006.01) |
| ***B41F 33/00*** | (2006.01) |
| ***B65H 23/32*** | (2006.01) |
| ***B41F 13/06*** | (2006.01) |
| ***B65H 20/02*** | (2006.01) |
| *B41J 3/60* | (2006.01) |

(52) U.S. Cl.

CPC ..... *B41F 33/0036* (2013.01); *B41F 13/06* (2013.01); *B41J 15/165* (2013.01); *B65H 20/02* (2013.01); *B65H 23/32* (2013.01); *B41J 3/60* (2013.01); *B65H 2301/5111* (2013.01); *B65H 2701/1133* (2013.01); *B65H 2801/03* (2013.01)

(58) Field of Classification Search

CPC ..... B41J 15/165
USPC ..... 101/483
See application file for complete search history.

(56) References Cited

U.S. PATENT DOCUMENTS 4,619,279 A * 10/1986 Shiga ..... A24D 3/064 131/345
4,788,846 A 12/1988 Morita et al.
5,108,022 A * 4/1992 Birkmair ..... B65H 23/32 226/15
5,277,415 A 1/1994 Kinoshita
(Continued)

FOREIGN PATENT DOCUMENTS

CN 1103049 5/1995
CN 1689805 11/2005
(Continued)

OTHER PUBLICATIONS

Katz, S., "Inspection Equipment", Label & narrow Web, Rodman Media, 2010, 9pages.

*Primary Examiner* — Anthony H Nguyen
(74) *Attorney, Agent, or Firm* — HP Inc. Patent Department

(57) ABSTRACT

In one example, a printed output inspection unit (300) for a web printing system (100). The inspection unit has a first L-inverter (310) disposed in a first plane (315), and a second L-inverter (320) disposed in a second plane (325) offset from the first plane in a direction orthogonal to the first plane. The inspection unit (300) also has an inspection area (340,350) between the first and second L-inverters to view a side (307,309) of a web substrate (305), the inspection area extending in the direction orthogonal to the first plane.

13 Claims, 9 Drawing Sheets

(56) References Cited

U.S. PATENT DOCUMENTS

| | | | | | |
|---|---|---|---|---|---|
| 5,467,179 | A * | 11/1995 | Boeck | B41F 13/06 | 101/223 |
| 5,860,053 | A | 1/1999 | Stemmle | | |
| 5,996,491 | A * | 12/1999 | Kishine | B41F 13/06 | 101/222 |
| 8,127,673 | B2 * | 3/2012 | Malottki | G03G 15/23 | 101/230 |
| 8,128,088 | B2 | 3/2012 | Suh | | |
| 8,401,455 | B2 | 3/2013 | Suh | | |
| 8,992,004 | B2 * | 3/2015 | Leighton | B65H 23/32 | 347/104 |
| 9,193,192 | B1 * | 11/2015 | Regelsberger | B41J 15/165 | |
| 2010/0059567 | A1 * | 3/2010 | Opfer | B41F 13/06 | 226/1 |
| 2013/0341857 | A1 * | 12/2013 | Herrmann | B41J 3/60 | 271/225 |

FOREIGN PATENT DOCUMENTS

| | | |
|---|---|---|
| CN | 102834270 | 12/2012 |
| DE | 8601898 | 4/1986 |
| DE | 4302698 | 8/1994 |
| EP | 0342491 | 11/1989 |
| EP | 2749414 | 7/2014 |
| JP | 07206240 | 8/1995 |
| JP | 200019791 | 1/2000 |
| JP | 2011177980 | 9/2011 |
| SE | 408770 | 7/1979 |

* cited by examiner

PRINTED OUTPUT INSPECTION

BACKGROUND

Web printing systems print on a continuous print medium (also referred to as a web substrate, or substrate). The substrate may be supplied in roll form. The substrate flows through at least one station of the web printing system during the printing process. In some systems, one side of the substrate is printed by a first station, and the opposite side of the substrate is subsequently printed by another station. A user or operator may wish to view the printed substrate at various points in the system. This can be challenging when printing wider substrates.

DETAILED DESCRIPTION

Figure 1:
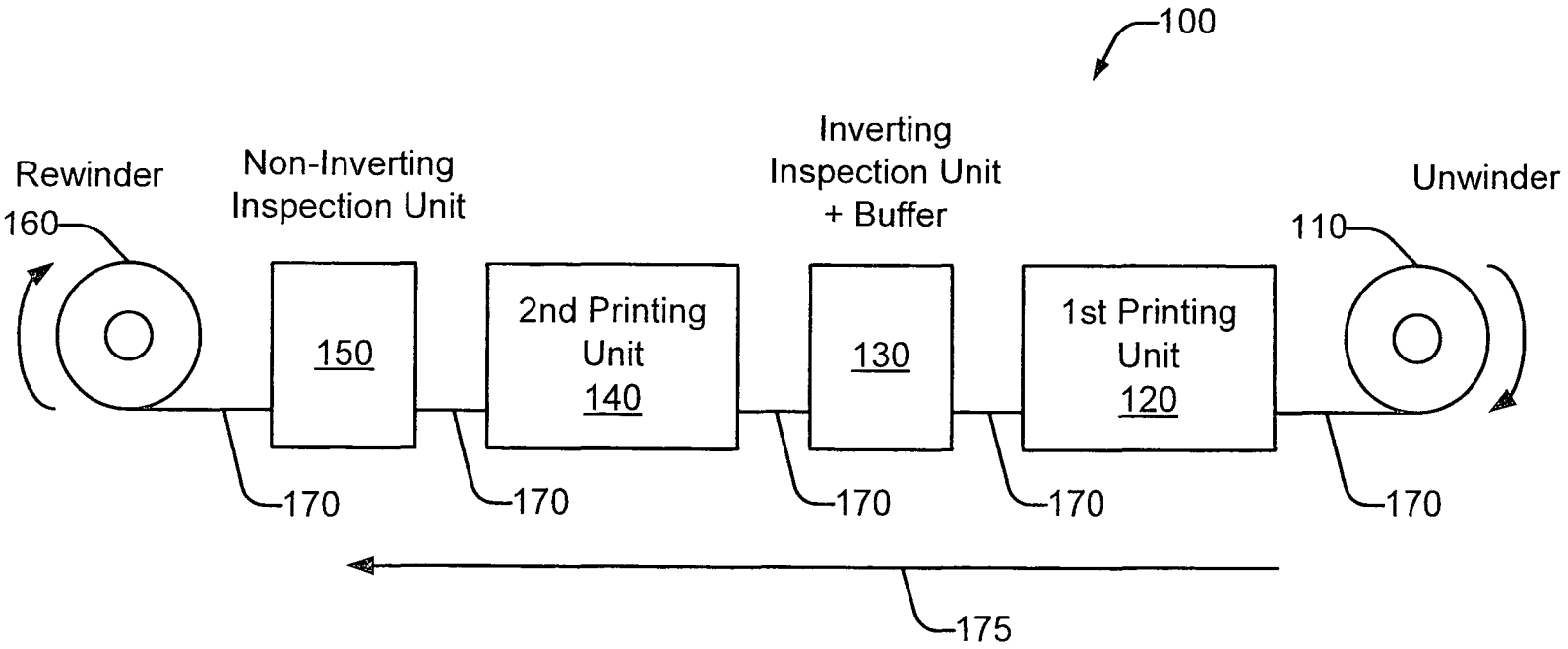
FIG. 1 is a block diagram of a web printing system in accordance with an example of the present disclosure.

Some web printing systems include an inspection or viewing zone for the substrate, which may be an inspection table. The inspection table may be disposed after a particular unit of the printing system, or between two units of the printing system. The web substrate flows through the inspection table during printing. The viewing surface of the inspection table may be positioned at a convenient height, much like a worksurface of a desk, such that the operator of the printing system can inspect the printed output as printing proceeds.

An inspection table may be used effectively with a web substrate that is 340 millimeters in width. When used with wider web substrates, however, such as a substrate that is 760 millimeters in width, an inspection table may become non-optimal. From an ergonomic perspective, a user positioned adjacent to one edge of the substrate may not be able to see printed output that is located near the opposite edge of the substrate well enough to properly assess its quality. The user may have to bend or lean over the inspection table to do so, causing strain or fatigue after a period of time.

Also, in some configurations, the inspection table may be combined into a single unit with other substrate-handling mechanisms such as a web buffer (to store a portion of the substrate in-between two units of the printing system which supply and/or receive the substrate at different rates and/or times) and/or a web guide (to properly align the substrate in the cross-web direction). In many cases, these mechanisms are arranged linearly in the direction of the flow of the web substrate. In such configurations, increasing the width of the substrate not only increases the width of the single unit, but also its length. This is because a "quiet zone" spacing between a pair of units which manipulate the web substrate should be at least 60% of the cross-web width of the substrate in order to minimize of eliminate disturbances in the substrate between units. This undesirably increases the floor space that is occupied by the printing system in two dimensions, not just one.

Referring now to the drawings, there is illustrated an example of a printed output inspection unit for a web printing system. Two L-inverters are disposed in planes which are offset from each other in a direction orthogonal to one or both of the planes. An inspection area which allows viewing of a side of the web substrate flowing through the system extends between the two L-inverters in the orthogonal direction. Where the orthogonal direction is vertical, the inspection area is a vertical inspection wall, rather than a horizontal table. The operator of the system can easily and ergonomically view the printed output in the inspection area by standing in front of the printing system, with no need for bending over. Also, a web buffer and/or a web guide may be disposed within the vertical space between the two L-inverters, thus minimizing the footprint used for these units.

Considering now an example web printing system, and with reference to FIG. 1, a web printing system 100 includes an unwinder unit 110, a first printing unit 120, an inverting inspection unit 130 including a web buffer, a second printing unit 140, a non-inverting inspection unit 150, and a rewinder unit 160. A continuous web substrate 170 flows through the various units 110-160 of the printing system 100 in the direction 175 during a printing operation. In FIG. 1, this flow direction 175 is from right to left, and the relative positioning of the units 110-160 can be indicative of a front view of the printing system 100.

The unwinder 110 supplies the continuous web substrate 160 by unwinding it off a roll of print media. The first and second printing units 120, 140 print on one side of the substrate.

Other web printing systems may have fewer or more units, and/or different kinds of units. In some examples, an additional unit (not shown) between the second printing unit 140 and the rewinder 160 may perform post-processing substrate-handling operations on the printed substrate, such as perforating or laminating the substrate. The inverting inspection unit 130 and/or the non-inverting inspection unit 150 may be repositioned or omitted. Where one side of the substrate 170 is to be printed but not the other side, the second printing unit 140 may be omitted. A double-side printing unit (not shown) may be used in place of either or both of the printing units 120, 140. A in-line primer unit (not shown) to prepare the substrate for receiving colorant may be inserted between the first printing unit 120 and the unwinder 110. These are just a few of the printing system configurations in which an inverting inspection unit 130 and/or an non-inverting inspection unit 150 may be used.

Figures 2A, 2B:
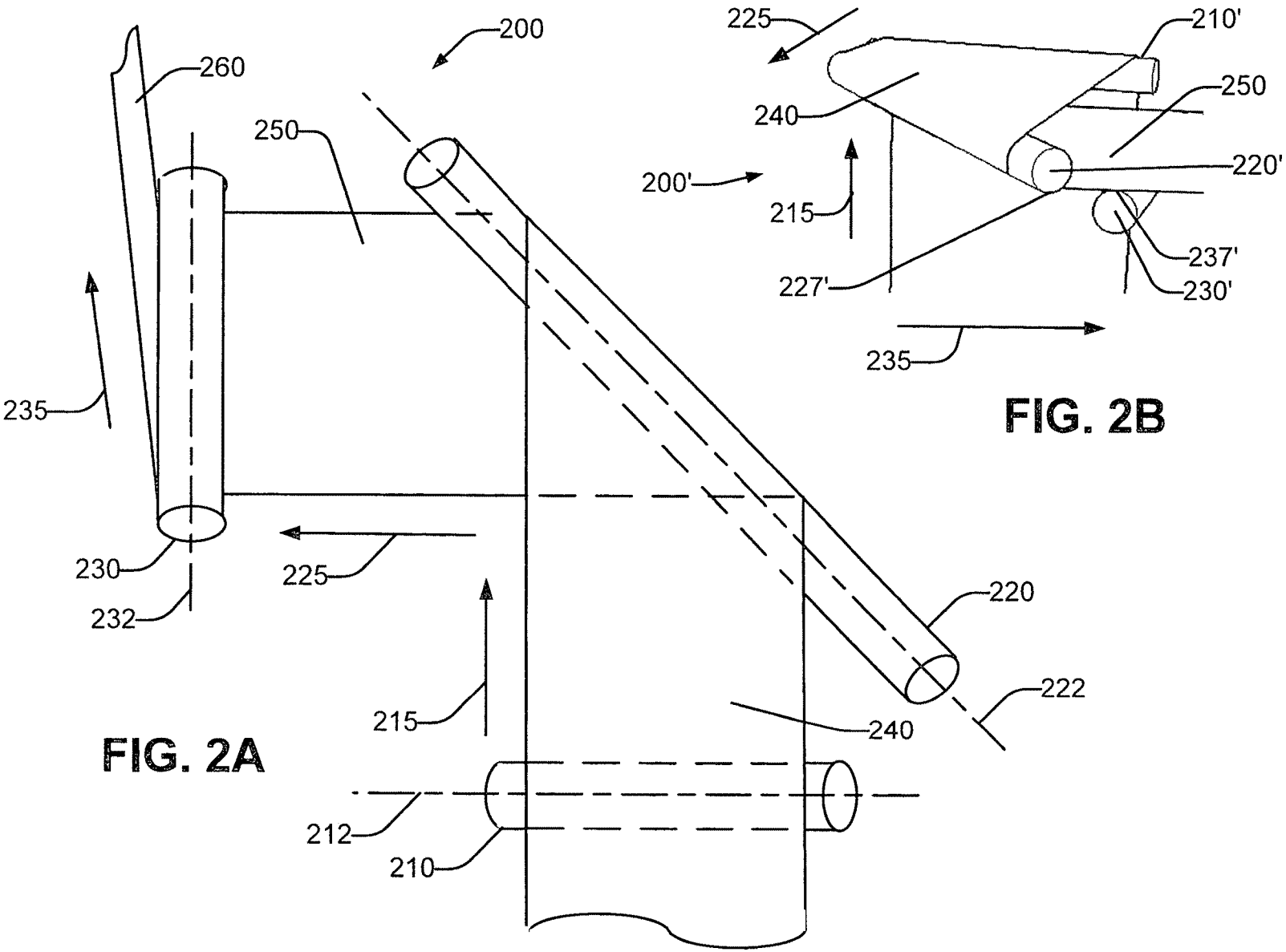
FIGS. 2A-2B are schematic diagrams of L-inverters in accordance with an example of the present disclosure and usable in a printed output inspection unit of the web printing system of FIG. 1.

Considering now an L-inverter, and with reference to FIGS. 2A-2B, an L-inverter 200 includes an input roller 210, an angled roller 220, and an output roller 230. The rollers 210, 220, 230 are cylindrical in shape, with a corresponding central axis 212, 222, 232 respectively.

The L-inverter 200 is a substrate-handling mechanism which both inverts the substrate and rotates the flow direction of the substrate by 90 degrees. The input roller 210 receives the web substrate. In some examples, the web substrate may wrap around the input roller 210 a certain number of degrees such that the input roller 210 redirects the substrate from one plane to another, while in other examples the web substrate does not wrap around the input roller 210 and the plane of the substrate does not change. The substrate exits the input roller 210 in an incoming plane 240, flowing in direction 215. The angled roller 220 is disposed at an angle to the flow direction 215, in one example 45 degrees. The web substrate wraps helically around the angled roller 220. In one example the substrate wraps 180 degrees around the roller 220. The web substrate exits the angled roller 220 in an intermediate plane 250, flowing in a direction 225. The flow direction 225 is substantially orthogonal to the flow direction 215, and the planes 240, 250 are substantially parallel. The output roller 230 receives the web substrate from the angled roller 220. In some examples, the web substrate wraps around the output roller 230, thus redirecting the web substrate from plane 250 and flow direction 225 to plane 260 and flow direction 235. In one of these examples, the flow direction 235 is substantially orthogonal to the flow direction 225, and the plane 260 is substantially orthogonal to the plane 250. In other examples, the web substrate does not wrap around the output roller 230; in this case, neither the plane of the substrate nor its flow direction are changed by the output roller 230.

In some examples, the L-inverter 200 may include additional rollers (not shown). In one such example, if the substrate does not wrap around the roller 210, 230, an opposing roller may be disposed on the opposite side of, and in contact with, the web substrate in order to maintain the substrate in engagement with, and/or a desired tension in the web at, the roller 210, 230.

In some examples, an L-inverter 200 may be considered as being disposed in a particular plane. In some such examples, as illustrated in FIG. 2A, the plane of the L-inverter 200 may be considered as a common plane of the three coplanar central axes 212, 222, 232. In other such examples, as illustrated in FIG. 2B, the plane of an L-inverter 200' is a common plane of surface points on the three rollers 210', 220', 230'. In some examples, these surface points for roller 220' may be the line of points at radial position 227', while the surface points for roller 230' may be the line of points at radial position 237'. In this case the radial positions 227', 237' are different. Using surface points instead of central axes to define the L-inverter plane accommodates a roller, such as roller 230', that is disposed above or below a plane formed by the axes of the other two rollers due to the desired input or output direction of the L-inverter.

Figure 3A:
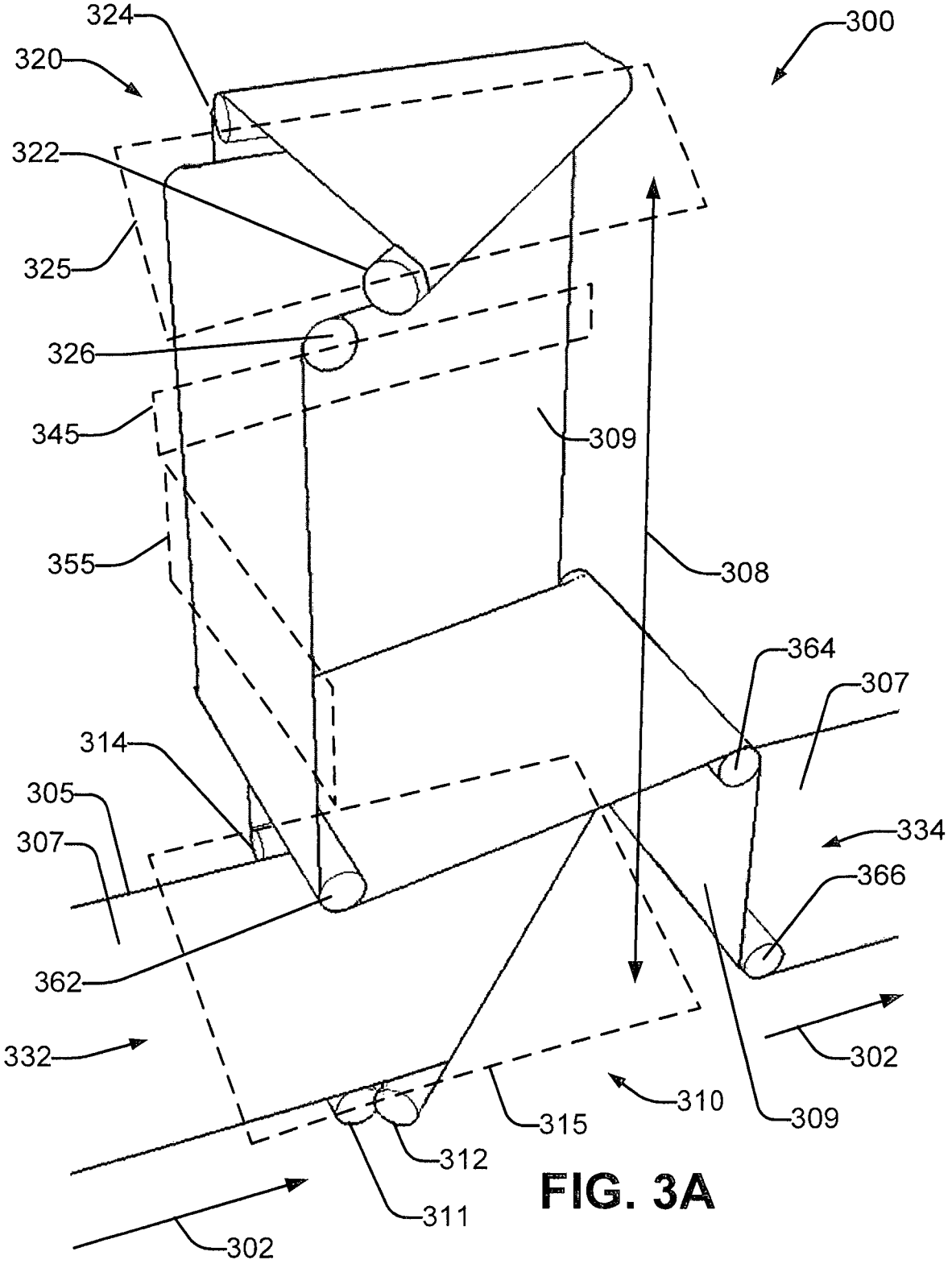
FIG. 3A is a schematic diagram of a non-inverting inspection unit in accordance with an example of the present disclosure and usable in the web printing system of FIG. 1.
Figure 3B:
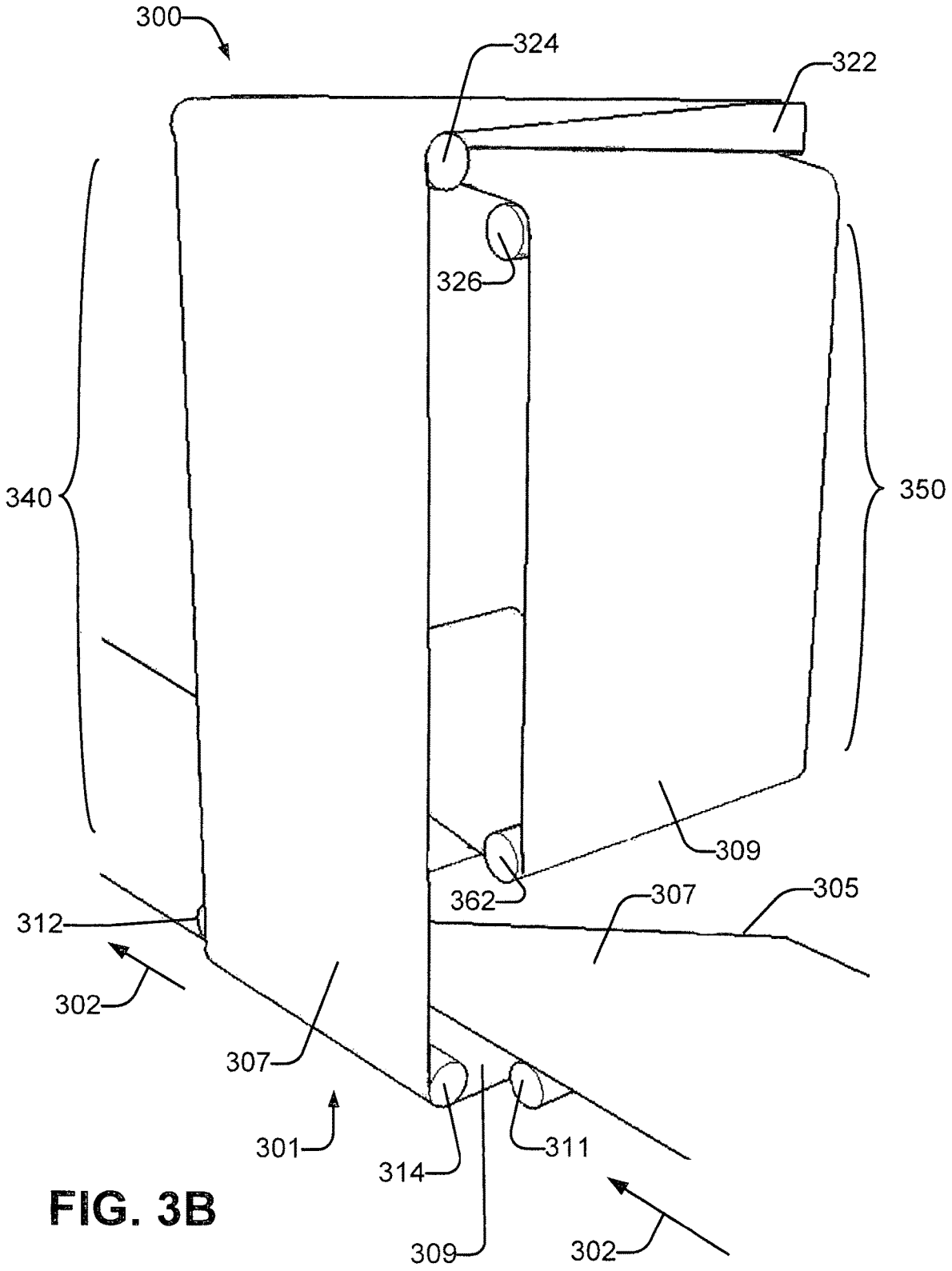
FIG. 3B is a schematic diagram of a different view in accordance with an example of the present disclosure of the non-inverting inspection unit of FIG. 3A and showing two inspection areas, one for each side of a web substrate.

Considering now a non-inverting inspection unit usable in a web printing system, and with reference to FIGS. 3A-3B, an example non-inverting inspection unit 300 receives a web substrate 305 flowing in a direction 302 and outputs the web substrate 305 in the same direction 302.

The non-inverting inspection unit 300 includes a first L-inverter 310 disposed in a first plane 315 and a second L-inverter 320 disposed in a second plane 325 offset from the first plane 315 in a direction of an axis 308 orthogonal to the first plane 310. A first inspection area 340 to view a first side 307 of the web substrate 305 is located between the first and second L-inverters 310, 320. The first inspection area 340 extends in a direction of the axis 308 orthogonal to the first plane 310, and defines a third plane 345.

The non-inverting inspection unit 300 also includes a second inspection area 350 between the first and second L-inverters 310, 320 to view a second, opposite side 309 of the web substrate 305, the second inspection area 350 extending in a direction of (or along) the axis 308 orthogonal to the first plane 315 and defining a fourth plane 355 that is different from the first, second, and third planes 315, 325, 345.

The first L-inverter 310 receives the substrate 305 from a source external to the inspection unit 300 at an entrance 332. The first L-inverter 310 then supplies the substrate 305 downstream in an upwards direction towards the second L-inverter 320. The second L-inverter 320 receives the substrate 305 after the first L-inverter 310 and supplies the substrate 305 downstream towards an exit 334 of the inspection unit 300. The inspection unit 300 is "non-inverting" in that the web substrate 305 has the same orientation at both the entrance 332 and the exit 344; i.e. the same side 307 of the web substrate 305 is facing up at both the entrance 332 and the exit 344.

In some examples, the first and second planes 315, 325 are substantially parallel to each other and to a bottom surface 301 of the inspection unit 300. In some examples, the third and fourth planes 345, 355 are substantially vertical, and substantially orthogonal to each other.

The first L-inverter 310 has a first angled roller 312, which is positioned in a first orientation in the first plane 315. The second L-inverter 320 has a second angled roller 322 positioned in a second orientation in the second plane 325. The axis of the first angled roller 312 and the axis of the second angled roller 322 are substantially coplanar. The coplanar alignment of the angled rollers 312, 322 results in the non-inverting characteristic of the inspection unit 300.

In some examples, the inspection unit 300 is disposed within a substantially rectangular enclosure (not shown). In some examples, the geometry of the inspection unit 300 and the enclosure may be arranged to minimize its footprint while allowing the height to be adjusted as needed. Furthermore, the height of the inspection unit 300 is such that the first and second inspection areas 340, 350 have a sufficient length in the flow direction so as to allow ergonomic viewing by an operator regardless of the height of the person. They also have a sufficient length in the flow direction to ensure that a quiet zone of the appropriate distance exists between rollers 314, 324; between rollers 326, 362; between rollers 362, 364; and between rollers 364, 366. When the non-inverting inspection unit 300 is used in the web printing system 100 (FIG. 1), an operator standing on the front side of the web printing system 100 at a front corner of the inspection unit 300, as illustrated in FIG. 3B, can view both sides 307, 309 of the web substrate 305 as it flows through the printing system 100 and thus assess the printed output on both sides 307, 309. The enclosure may have an open wall, or alternatively a wall with a transparent covering, in front of the first and/or second inspection areas 340, 350. In examples where the inspection areas 340, 350 are oriented vertically, unlike an inspection table there may be no structure used to support the substrate 305 in the inspection areas 340, 350.

In operation, the web substrate 305 is received at input 332 of the inspection unit 300, and from input roller 311 passes through L-inverter 310, where the substrate 305 is inverted and rotated 90 degrees in plane 315. The substrate 305 is redirected upward from the output roller 314 of L-inverter 310 to the input roller 324 of L-inverter 320, which redirects it into plane 325. The substrate 305 then passes through L-inverter 320, where the substrate 305 is inverted and rotated 90 degrees in plane 325. The substrate 305 is then redirected downward from the output roller 326 of L-inverter 320 to a roller 362. The substrate 305 is redirected by the roller 362 to a roller 364, which in turn redirects the substrate 305 to a final roller 366 at the exit 334 of the inspection unit 300.

Figure 4A:
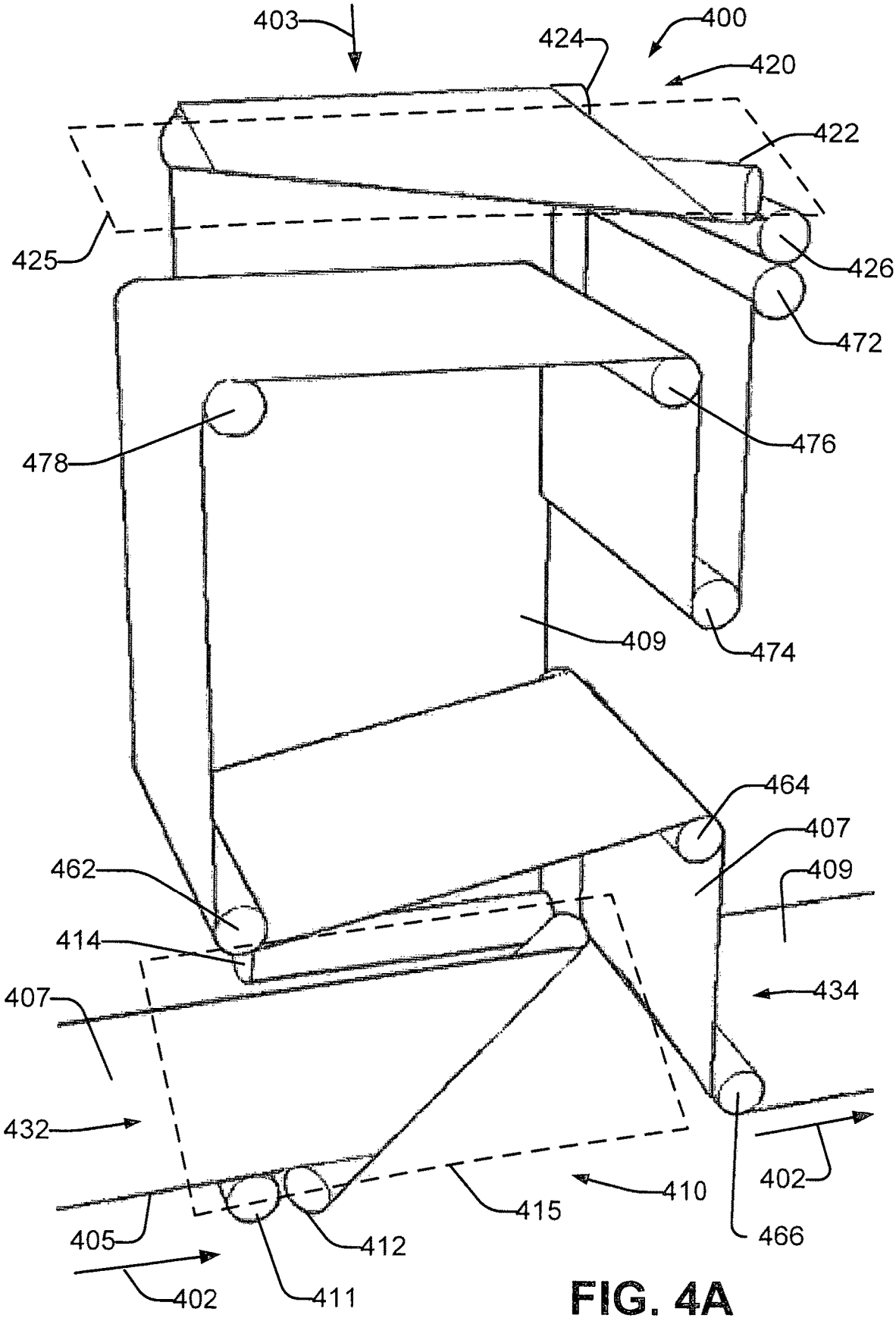
FIG. 4A is a schematic diagram of an inverting inspection unit in accordance with an example of the present disclosure.
Figure 4B:
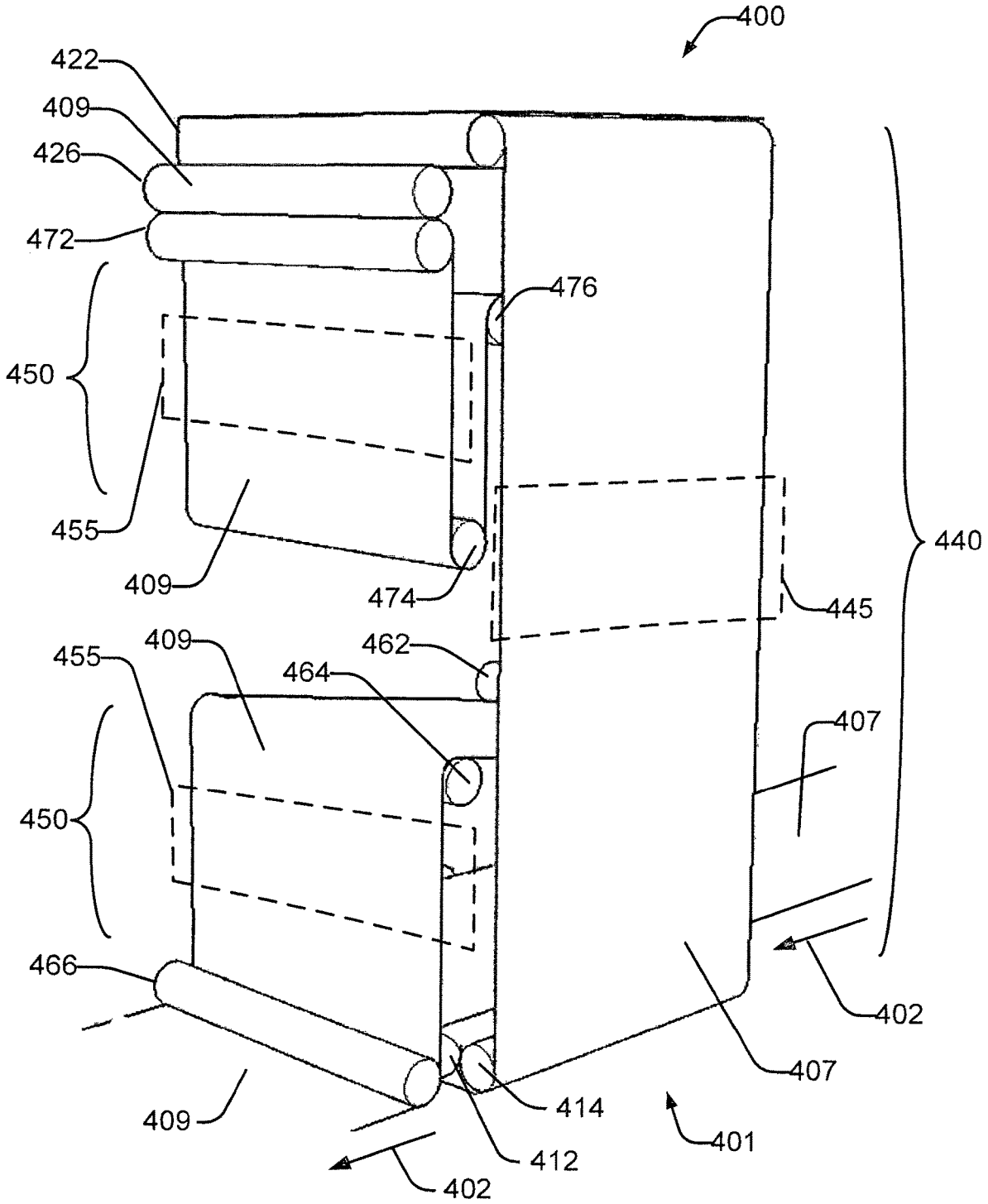
FIG. 4B is a schematic diagram of a different view in accordance with an example of the present disclosure of the inverting inspection unit of FIG. 4A and showing two inspection areas, one for each side of a web substrate.

Considering now an inverting inspection unit usable in a web printing system, and with reference to FIGS. 4A-4B, an example inverting inspection unit 400 receives a web substrate 405 flowing in a direction 402 and outputs the web substrate 405 in the same direction 402.

The inverting inspection unit 400 includes a first L-inverter 410 disposed in a first plane 415 above a bottom surface 401 of the unit 400. The bottom surface may be, for example, the bottom surface of a chassis on or in which the unit 400 is mounted. The first L-inverter 410 has a first angled roller 412, which is positioned in a first orientation in the first plane 415. The inverting inspection unit 400 has a second L-inverter 420, which is positioned in a second plane 425 above the first plane 415. The second L-inverter 420 has a second angled roller 422 in a second orientation in the second plane 425. The first orientation and the second orientation are substantially orthogonal. When viewed in a direction 403 that is substantially orthogonal to the first and second planes 415, 425, the first and second angled rollers 412, 422 form an "X". Put another way, an axis of the first angled roller 412 is substantially orthogonal to an axis of the second angled roller 422. The orthogonal alignment of the angled rollers 412, 422 results in the inverting characteristic of the inspection unit 400. Other types of inverting inspection units may utilize a turn bar, also known as an X-inverter, to invert the substrate without changing the flow direction. Two orthogonally aligned L-inverters, such as L-inverters 410 and 420, can function as an X-inverter. By separating the two L-inverters 410, 420 in the vertical direction, a void between them is formed into which other elements of the web printing system can be disposed without enlarging the system footprint, as discussed subsequently with reference to FIGS. 5 and 6.

The inverting inspection unit 400 has a first inspection area 440 to view a first side 407 of the web substrate 405 from outside the inspection unit 400. The first inspection area 440 is located between the first and second L-inverters 410, 420 in a third plane 445 that is substantially orthogonal to the first and second planes 415, 425.

The inverting inspection unit 400 also includes at least one second inspection area 450 between the first and second L-inverters 410, 420 to view a second, opposite side 409 of the substrate 405 from outside the inspection unit 400. The second inspection area 450 extends partway between the first and second planes 415, 425, and defines a fourth plane 455 that is orthogonal to the first, second, and third planes 415, 425, 445. The third and fourth planes 445, 455 are substantially vertical, while the first and second planes 415, 425 are substantially horizontal. In examples having more than one second inspection area 450, the fourth planes 455 of the respective areas 450 may all be in the same plane, or in substantially parallel planes.

In some examples, the inspection unit 400 is disposed within a substantially rectangular enclosure (not shown). In some examples, the geometry of the inspection unit 400 and the enclosure may be arranged to minimize its footprint while allowing the height to be adjusted as needed. Furthermore, the height of the inspection unit 400 is such that the first and second inspection areas 440, 450 have a sufficient vertical span so as to allow ergonomic viewing by an operator regardless of the height of the person. They also have a sufficient vertical span to ensure that a quiet zone of the appropriate distance exists between rollers 414, 424; between rollers 472, 474; between rollers 474, 476; between rollers 476, 478; between rollers 478, 462; between rollers 462, 464; and between rollers 464, 466. When the inverting inspection unit 400 is used in the web printing system 100 (FIG. 1), an operator standing on the front side of the web printing system 100 at a front corner of the inspection unit 400, as illustrated in FIG. 4B, can view both sides 407, 409 of the web substrate 405 as it flows through the printing system 100, and thus assess the printed output on both sides 407, 409. The enclosure may have an open wall, or alternatively a wall with a transparent covering, in front of the first and/or second inspection areas 440, 450. In examples where the inspection areas 440, 450 are oriented vertically, unlike an inspection table there may be no structure used to support the substrate 405 in the inspection areas 440, 450.

In operation, the web substrate 405 is received at input 432 of the inspection unit 400, and from input roller 411 passes through L-inverter 410, where the substrate 405 is inverted and rotated 90 degrees in plane 415. The substrate 405 is redirected upward from the output roller 414 of L-inverter 410 to the input roller 424 of L-inverter 420, which redirects it into plane 425. The substrate 405 then passes through L-inverter 420, where the substrate 405 is inverted and rotated 90 degrees in plane 425. The substrate 405 is then wrapped halfway around output roller 426 of L-inverter 420 and halfway around roller 472 in a serpentine arrangement, and from there redirected downward to roller 474. The substrate 405 is wrapped halfway around roller 474 and redirected upward to roller 476, which redirects it to roller 478. Roller 478 redirects the substrate 405 downward to roller 462, which in turn redirects it to roller 464. From roller 464, the substrate 405 is redirected downward to a final roller 466 at the exit 434 of the inspection unit 400.

Figure 5:
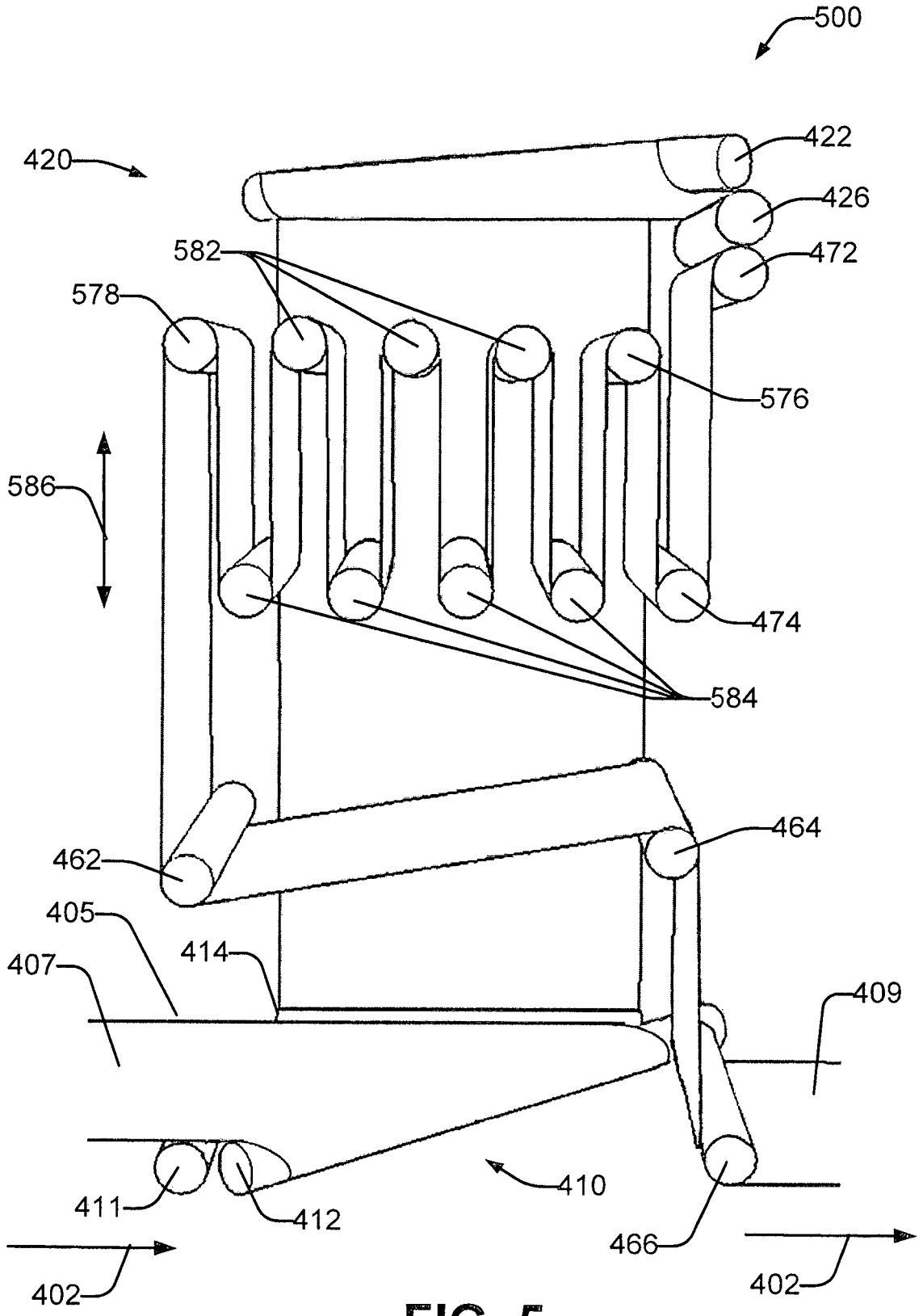
FIG. 5 is a schematic diagram of an inverting inspection unit including a web buffer in accordance with an example of the present disclosure and usable in the web printing system of FIG. 1.

Considering now another inverting inspection unit usable in a web printing system, and with reference to FIG. 5, an example inverting inspection unit 500 includes a web substrate buffer 550 disposed between, and within the footprint of, the first and second L-inverters 410, 420. The buffer 550 receives the substrate 405 after the second L-inverter 420, and accumulates the substrate within the buffer 550.

The inspection unit 500 can be deployed in a web printing system 100 (FIG. 1) in-between two adjacent units of the system 100 which supply and consume the substrate 405 at different rates and/or operate asynchronously from each other. In some examples, an adjacent upstream printing unit may print on the substrate 405 and supply it to the inspection unit 500 at a time when an adjacent downstream printing unit is not printing. The buffer 550 can accumulate the substrate 405 received from the upstream printing unit and retain it until the downstream printing unit begins printing. When the downstream printing unit begins printing, the buffer 550 begins to supply the accumulated substrate 405 to the downstream printing unit. If the upstream printing unit stops printing, the downstream printing unit can continue to print until the accumulation of substrate 405 in the buffer 550 has been exhausted.

The buffer 550 includes fixed rollers 582 and translatable rollers 584. The translatable rollers 584 are movable in the direction 586. As substrate 405 accumulated in the buffer 550, the translatable rollers 584 move downward away from the fixed rollers 582. As substrate 405 is consumed from the buffer 550, the translatable rollers 584 move upward towards the fixed rollers 582. The amount of upward and/or downward movement is controlled so as to properly maintain the tension in the web.

The elements of the inspection unit 500 other than the buffer 550 are the same as, or similar to, the corresponding elements of the inspection unit 400 (FIGS. 4A-4B). Roller 576 is similar to roller 476, except that the substrate 405 wraps halfway around roller 576 and redirects the substrate downward instead of horizontally. Roller 578 is similar to roller 478, except that roller 578 receives the substrate 405 traveling in an upward direction rather than a horizontal direction, and wraps it halfway around roller 578 to redirects the substrate 405 downward.

By separating the two L-inverters 410, 420 in the vertical direction to create inspection areas, and then by disposing the buffer 550 in the void between the two L-inverters 410, 420, the buffer 550 does not increase the footprint of the inspection unit 500 relative to the inspection unit 400 (FIGS. 4A-4B). In some examples, in an inspection unit 500 capable of handling a web substrate 405 that is 760 millimeters in width, and having a height of two meters to provide ergonomic inspection areas, the buffer 500 can store up to ten meters of the web substrate 405.

Figure 6A:
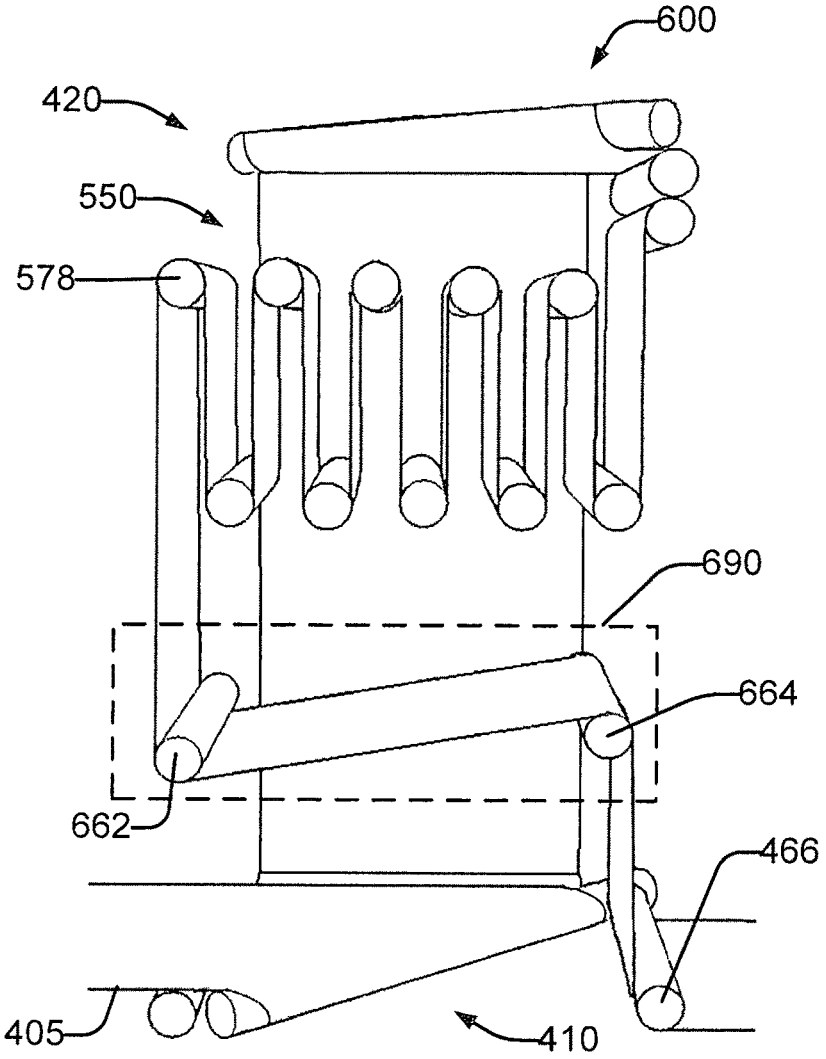
FIG. 6A is a schematic diagram of an inverting inspection unit including a web buffer and a web guide in accordance with an example of the present disclosure and usable in the web printing system of FIG. 1.
Figure 6B:
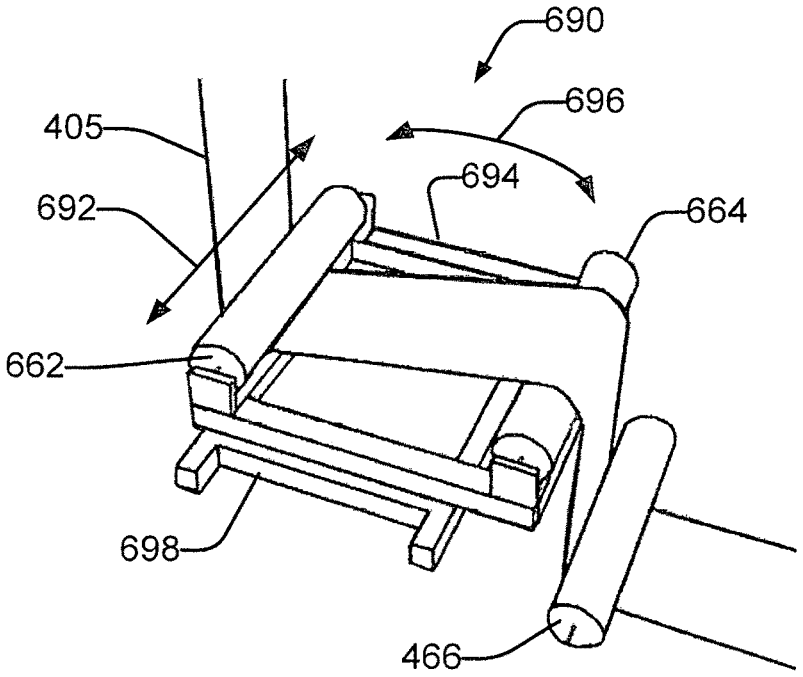
FIG. 6B is a schematic diagram of a web guide in accordance with an example of the present disclosure and usable in the inspection units of FIG. 3A-3B, 4A-4B, or 6A.

Considering now yet another inverting inspection unit usable in a web printing system, and with reference to FIGS. 6A-6B, an example inverting inspection unit 600 includes a web guide 690 disposed between, and within the footprint of, the first and second L-inverters 410, 420. The web guide 690 adjusts a position of the substrate 405 in a cross-web direction 692 prior to the substrate 405 existing the inspection unit 600. The web guide 690 receives the substrate 405 from roller 578 at roller 662, and after the position adjustment is performed, provides the substrate 405 from roller 664 to roller 466.

As the substrate 405 flows through the various units of the web printing system 100 (FIG. 1), and/or through the various elements of the inspection unit 600, the substrate 405 may become misaligned in the cross-web direction 692. The web guide 690 compensates for this and realigns the substrate 405 to the proper position in the cross-web direction 692. One example web guide 690 (FIG. 6B) has a platform 694 that is rotatable in the direction 696 in the plane of the substrate 405 relative to a fixed base 698 to which the platform 694 is rotatably attached. The rollers 662, 664 may be mounted to the platform 694, and therefore also rotatable in the direction 696 as the platform 694 is rotated. A sensor (not shown) detects the amount of cross-web misalignment in the substrate 405 as it flows into the web guide 690, in one example by detecting the position of an edge of the substrate 405. Based on the amount of misalignment, the platform 694 is controllably rotated in the direction 696 so as to bring the substrate 405 back into proper alignment. This adjustment may be performed on a continual basis.

The web guide 690 can alternatively be disposed in the non-inverting inspection unit 300 (FIG. 3) and/or the inverting (but bufferless) inspection unit 400 (FIGS. 4A-4B) in a similar manner as described for the inspection unit 600.

Figure 7:
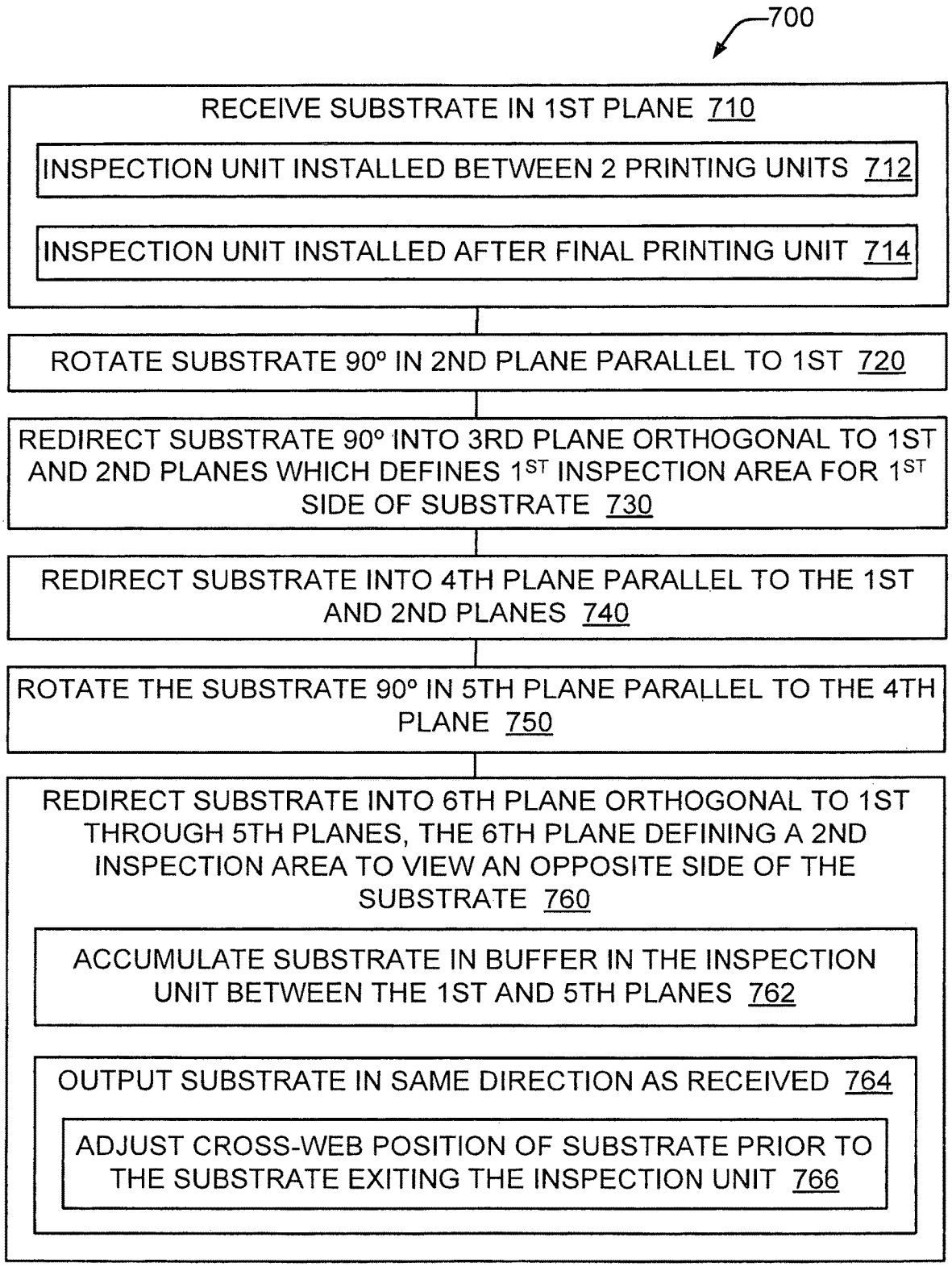
FIG. 7 is a flowchart according to an example of the present disclosure of a method of inspecting printed output of a web printing system.

Considering now an example method of inspecting printed output of a web printing system, and with reference to the flowchart of FIG. 7, an example method 700 begins at 710 by receiving a substrate of a web at an inspection unit. The substrate is received in a first plane, which may be parallel to a bottom surface of the inspection unit. Some examples, at 712, include installing an inspection unit in the web printing system in-between a first printing unit that prints one side of the substrate, and a second printing unit that prints an opposite side of the substrate. Some examples, at 714, include installing an inspection unit after a final printing unit of the web printing system. In some examples, multiple inspection units may be installed at different positions in the web printing system.

At 720, the substrate is rotated 90 degrees in a second plane that is parallel to the first plane. The second plane may be spaced apart from the first plane by a distance equal to the diameter of an angled roller used to perform the rotating.

At 730, the substrate is redirected into a third plane that is orthogonal to the first and second planes. The third plane defines a first inspection area for an operator to view a first side of the substrate from outside the inspection unit. The first inspection area may extend vertically.

At 740, the substrate is redirected into a fourth plane that is parallel to the first and second planes.

At 750, the substrate is rotated 90 degrees in a fifth plane that is parallel to the fourth plane. The fifth plane may be spaced apart from the fourth plane by a distance equal to the diameter of an angled roller used to perform the rotating.

At 760, the substrate is redirected into a sixth plane that is orthogonal to the first through fifth planes. The sixth plane defines a second inspection area for an operator to view an opposite side of the substrate from outside the inspection unit. The second inspection area may extend vertically. In some examples, at 762, the substrate is accumulated in a web substrate buffer within the inspection unit. The buffer is disposed between the first and the fifth planes, and within the footprint of the inspection unit. In some examples, at 764, the substrate is outputted (or supplied) from, and exits, the inspection unit flowing in the same direction from which the substrate was received at the inspection unit. In some examples, at 766, the position of the substrate is adjusted in a cross-web direction prior to the substrate exiting the inspection unit.

Terms of orientation and relative position (such as "top", "bottom", "side", "vertical", "horizontal", "upward", "downward", and the like) are not intended to indicate a particular orientation of any element or assembly, and are used only for convenience of illustration and description.

From the foregoing it will be appreciated that the printed output inspection units and method provided by the present disclosure represent a significant advance in the art. Although several specific examples have been described and illustrated, the disclosure is not limited to the specific methods, forms, or arrangements of parts so described and illustrated. The disclosure is not limited to inspection areas in which the substrate flows in an upward and/or downward direction, but includes inspection areas in which the substrate flows in a sideways direction. This description should be understood to include all novel and non-obvious combinations of elements described herein, and claims may be presented in this or a later application to any novel and non-obvious combination of these elements. The foregoing examples are illustrative, and different features or elements may be included in various combinations that may be claimed in this or a later application. Unless otherwise specified, operations of a method claim need not be performed in the order specified. Similarly, blocks in diagrams or numbers (such as (1), (2), etc.) should not be construed as operations that proceed in a particular order. Additional blocks/operations may be added, some blocks/operations removed, or the order of the blocks/operations altered and still be within the scope of the disclosed examples. Further, methods or operations discussed within different figures can be added to or exchanged with methods or operations in other figures. Further yet, specific numerical data values (such as specific quantities, numbers, categories, etc.) or other specific information should be interpreted as illustrative for discussing the examples. Such specific information is not provided to limit examples. The disclosure is not limited to the above-described implementations, but instead is defined by the appended claims in light of their full scope of equivalents. Where the claims recite "a" or "a first" element of the equivalent thereof, such claims should be understood to include incorporation of at least one such element, neither requiring nor excluding two or more such elements. Where the claims recite "having", the term should be understood to mean "comprising".

What is claimed is:

1. A printed output inspection unit for a web printing system, comprising:

a first L-inverter disposed in a first plane;

a second L-inverter disposed in a second plane offset from the first plane in a direction orthogonal to the first plane, wherein the first and second L-inverters are stacked in the direction orthogonal to the first plane to define a footprint of the inspection unit;

a first inspection area between the first and second L-inverters to view a first side of a web substrate, the first inspection area extending in the direction orthogonal to the first plane; and a substrate buffer disposed between the first and second L-inverters within the footprint and structured to receive the substrate after the second L-inverter and to accumulate the substrate within the buffer.

2. The inspection unit of claim 1, wherein the first inspection area defines a third plane, the inspection unit further comprising:

a second inspection area between the first and second L-inverters to view from outside the inspection unit an opposite side of the substrate, the second inspection area extending in the direction orthogonal to the first plane and defining a fourth plane that is different from the first, second, and third planes.

3. The inspection unit of claim 2, wherein the first and second planes are substantially parallel to each other and to a bottom of the inspection unit, and wherein the third and fourth planes are substantially vertical and substantially orthogonal to each other.

4. The inspection unit of claim 1, wherein the first L-inverter has a first angled roller in a first orientation in the first plane, wherein the second L-inverter has a second angled roller in a second orientation in the second plane, wherein an axis of the first angled roller and an axis of the second angled roller are substantially coplanar, and wherein the inspection unit is structured to receive the substrate in a given orientation and to output the substrate in the given orientation.

5. The inspection unit of claim 1, wherein the first L-inverter has a first angled roller in a first orientation in the first plane, wherein the second L-inverter has a second angled roller in a second orientation in the second plane, wherein an axis of the first angled roller is substantially orthogonal to an axis of the second angled roller, and wherein the inspection unit is structured to receive the substrate in a given orientation and to output the substrate in an inverted orientation.

6. The inspection unit of claim 1, wherein the first and second L-inverters are stacked in the direction orthogonal to the first plane to define a footprint of the inspection unit, the inspection unit further comprising:

a web guide disposed between the first and second L-inverters within the footprint and structured to adjust a position of the substrate in a cross-web direction [prior to the substrate existing the inspection unit].

7. A printer output inspection unit for a web printing system, comprising:

a first L-inverter disposed in a first plane above a surface and having a first angled roller in a first orientation;

a second L-inverter disposed in a second plane above the first plane and having a second angled roller in a second orientation substantially orthogonal to the first orientation, wherein the first and second L-inverters define a footprint of the inspection unit on the surface;

a first inspection area between the first and second L-inverters in a plane substantially orthogonal to the first and second planes, to view a first side of a web substrate from outside the inspection unit; and a substrate buffer disposed between the first and second L-inverters within the footprint and structured to receive the substrate after the second L-inverter and to accumulate the substrate within the buffer.

8. The inspection unit of claim 7, comprising:

a second inspection area between the first and second L-inverters in a plane substantially orthogonal to the first, second, and third planes, to view an opposite side of the substrate from outside the inspection unit.

9. The inspection unit of claim 7, wherein the first and second L-inverters define a footprint of the inspection unit on the surface, the inspection unit further comprising:

a web guide disposed between the first and second L-inverters within the footprint and structured to adjust a position of the substrate in a cross-web direction.

10. A method of inspecting printed output of a web printing system, comprising:

receiving, at an inspection unit, a substrate of a web in a first plane parallel to a surface;

rotating the substrate 90 degrees in a second plane parallel to the first plane;

redirecting the substrate into a third plane orthogonal to the first and second planes, the third plane defining a first vertical inspection area to view a first side of the substrate;

redirecting the substrate into a fourth plane parallel to the first and second planes;

rotating the substrate 90 degrees in a fifth plane parallel to the fourth plane;

redirecting the substrate into a sixth plane orthogonal to the first through fifth planes, the sixth plane defining a second vertical inspection area to view an opposite side of the substrate.

11. The method of claim 10, comprising:

accumulating the substrate in a web buffer disposed within the inspection unit and between the first and fifth planes.

12. The method of claim 10, comprising:

adjusting a position of the substrate in a cross-web direction prior to the substrate exiting the inspection unit.

13. A web printing system, comprising:

a printing unit to print on a substrate;

a printed output inspection unit downstream from the printing unit to receive the printed substrate, the unit having a first L-inverter disposed in a first plane;

a second L-inverter disposed in a second plane offset from the first plane in a direction orthogonal to the first plane, wherein the first and second L-inverters are stacked in the direction orthogonal to the first plane to define a footprint of the inspection unit;

a first inspection area between the first and second L-inverters to view a first side of a web substrate, the first inspection area extending in the direction orthogonal to the first plane; and a substrate buffer disposed between the first and second L-inverters within the footprint and structured to receive the substrate after the second L-inverter and to accumulate the substrate within the buffer.

* * * * *